US007568783B2

(12) United States Patent
Katayama

(10) Patent No.: US 7,568,783 B2
(45) Date of Patent: Aug. 4, 2009

(54) INKJET HEAD

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 556 days.

(21) Appl. No.: 11/042,112

(22) Filed: Jan. 26, 2005

(65) Prior Publication Data

US 2005/0168536 A1 Aug. 4, 2005

(30) Foreign Application Priority Data

Jan. 29, 2004 (JP) ..... 2004-021459

(51) Int. Cl.
*B41J 2/155* (2006.01)
*B41J 2/045* (2006.01)

(52) U.S. Cl. ..... 347/42; 347/68; 347/70; 347/71; 347/72

(58) Field of Classification Search ..... 347/42, 347/68, 70, 71, 72
See application file for complete search history.

(56) References Cited

U.S. PATENT DOCUMENTS

| | | | | |
|---|---|---|---|---|
| 5,258,629 | A * | 11/1993 | Itoh et al. | 257/88 |
| 6,652,081 | B2 * | 11/2003 | Shimizu | 347/85 |
| 2002/0012029 | A1 * | 1/2002 | Miyata | 347/68 |
| 2002/0075362 | A1 | 6/2002 | Nakamura et al. | |
| 2002/0080215 | A1 * | 6/2002 | Sakaida et al. | 347/71 |
| 2003/0001931 | A1 * | 1/2003 | Isono | 347/72 |
| 2003/0103115 | A1 * | 6/2003 | Watanabe et al. | 347/68 |
| 2003/0156157 | A1 * | 8/2003 | Suzuki et al. | 347/50 |
| 2003/0156167 | A1 * | 8/2003 | Sakaida et al. | 347/68 |
| 2004/0114004 | A1 * | 6/2004 | Taira | 347/87 |
| 2004/0119790 | A1 * | 6/2004 | Taira | 347/68 |
| 2004/0218018 | A1 * | 11/2004 | Sakaida et al. | 347/68 |
| 2005/0052492 | A1 * | 3/2005 | Ikeda et al. | 347/40 |
| 2005/0062806 | A1 * | 3/2005 | Terakura et al. | 347/72 |

FOREIGN PATENT DOCUMENTS

| | | |
|---|---|---|
| EP | 0 755 792 A2 | 1/1997 |
| JP | A 2002-225263 | 8/2002 |
| JP | 2003-311953 | 11/2003 |

* cited by examiner

*Primary Examiner*—Stephen D Meier
*Assistant Examiner*—Sarah Al-Hashimi
(74) *Attorney, Agent, or Firm*—Oliff & Berridge, PLC

(57) ABSTRACT

An inkjet head has a passage unit where individual ink passages are formed, and an actuator unit bonded onto the upper surface of the flow passage unit. On the upper surface of the actuator unit, plural individual electrodes are positioned opposing pressure chambers. The plural individual electrodes form plural individual electrode rows. Each individual electrode includes a main electrode region disposed where the pressure chamber is opposed, and an auxiliary electrode region connected to the main electrode region and a FPC terminal. In the individual electrode row closest to a base-end side of the FPC, the individual electrodes whose auxiliary electrode regions are on the tip-end side of the FPC in relation to the main electrode regions and the individual electrodes whose auxiliary electrode regions are on the base-end side of the FPC 50 in relation to the main electrode regions are mixed.

17 Claims, 10 Drawing Sheets

INKJET HEAD

BACKGROUND OF THE INVENTION

1. Field of the Invention

The present invention relates to an inkjet head for printing by ejecting ink onto a recording medium.

2. Description of the Related Art

In an inkjet printer or the like, an inkjet head distributes ink supplied from an ink tank to a plurality of pressure chambers, and selectively applies pressure pulses onto the respective pressure chambers, thereby ejecting ink out of nozzles. In some cases, an actuator unit, which is configured by laminating a plurality of piezoelectric sheets made of piezoelectric ceramics, is employed as a member for selectively applying pressure to the pressure chambers.

As an example of such an inkjet head, an inkjet head having a plurality of actuator units configured by sandwiching a continuous flat piezoelectric sheet between a common electrode and a plurality of individual electrodes has been known (see JP-A-2003-311953). The common electrode is formed so as to extend over a plurality of pressure chambers. The plurality of individual electrodes are configured by main electrode sections disposed so as to oppose the respective pressure chambers, and auxiliary electrode sections to which voltage is applied from the outside. When the individual electrode is set to be of a different potential from that of the common electrode upon supply of driving voltage from a flexible printed circuit (FPC), a portion of the piezoelectric sheet, which is sandwiched between the individual electrodes and the common electrode and which is polarized in the lamination direction, is expanded or contracted in the lamination direction by a so-called longitudinal piezoelectric effect. Accordingly, the volume of the pressure chamber is changed, thereby enabling ejection of ink from a nozzle communicating with the pressure chamber toward a recording medium. In addition, in a single actuator unit, all the individual electrodes are configured such that all the auxiliary electrode sections are formed on the same side with respect to the main electrode sections and facing a one direction. Meanwhile, on the FPC which is to be connected to the auxiliary electrode sections, a plurality of connecting pads (terminals) are formed in correspondence to the arrangement of the respective auxiliary electrode sections.

SUMMARY OF THE INVENTION

However, in the inkjet head disclosed in JP-A-2003-311953, all the auxiliary electrode sections of the plurality of individual electrodes of the actuator unit are arranged so as to face one direction. Therefore, as the pressure chambers are arranged at higher density in order to meet demand for images of higher resolution or high-speed printing, pitches between the auxiliary electrode sections decrease, whereby pitches between the respective connecting pads of the FPC which correspond to the respective auxiliary electrode sections decrease. As a result, widths of wires or pitches between wires extending from the respective connecting pads of the FPC are being decreased to such an extent to exceed a manufacturing limit. This becomes an obstacle against meeting demand for images of higher resolution or for increasing density of pressure chambers, and brings about a problem that the inkjet head is increased in size.

It is an object of the invention to provide an inkjet head which can increase pitches between wires formed on a flat flexible cable such as an FPC without increasing pitches between individual electrodes.

According to one aspect of the invention, the inkjet head has a flow passage unit, an actuator unit, and a flat flexible cable. The flow passage unit has ink flow passages in which a plurality of pressure chambers, which respectively communicate with nozzles, are arranged on a plane, and which connect ink supply ports with the nozzles by way of the pressure chambers inside the flow passage unit. The actuator unit has a plurality of individual electrodes, each of which has a main electrode region formed corresponding to the pressure chamber and an auxiliary electrode region connected to the main electrode region. The actuator unit is fixed on the plane of the flow passage unit and imparts ejection energy to ink inside the pressure chamber. The flat flexible cable has a plurality of terminals which are electrically connected with the respective auxiliary electrode regions, and is configured such that a plurality of wires, which are respectively connected to the plurality of terminals, extend in a one direction so as to extend from the terminals. In the actuator unit, a plurality of individual electrode rows, in each of which a plurality of the individual electrodes are arranged along a direction crossing the one direction, are arranged in such a manner that the individual electrode rows are parallel to each other. In at least the individual electrode row, among the plurality of individual electrode rows, which is the most distant from a tip end of the flat flexible cable in a direction along which the wires extend, the individual electrodes whose auxiliary electrode regions are located closer to the tip-end side of the flat flexible cable than are the main electrode regions and the individual electrodes whose auxiliary electrode regions are located closer to the base-end side of the flat flexible cable than are the main electrode regions are present in a mixed manner.

According to the above configuration, widths and pitches of the wires formed in the flat flexible cable can be increased to a comparatively great extent. More specifically, in the electrode row closest to the base end of the flat flexible cable, the individual electrodes whose auxiliary electrode regions are located closer to the tip-end side of the flat flexible cable than are the main electrode regions and the individual electrodes whose auxiliary electrode regions are located closer to the base-end side of the flat flexible cable than are the main electrode regions are present in a mixed manner. Accordingly, there can be such cases that another auxiliary electrode region is not present between two auxiliary electrode regions located closer to the base-end side of the flat flexible cable than are the main electrode regions. Between two such auxiliary electrode regions, a plurality of wires having comparatively great widths or pitches there between can be formed. Accordingly, fabrication of the flat flexible cable is facilitated. Furthermore, demands for higher density of images or for increasing the density of the pressure chambers can be satisfied, while preventing an accompanying increase in size of the inkjet head.

In addition, from another aspect of the invention, the inkjet head of the invention has a flow passage unit, an actuator unit, and a flat flexible cable. The flow passage unit has a flow passage unit having ink flow passages in which a plurality of pressure chambers, which communicate with respective nozzles, are arranged on a plane, and which connect ink supply ports with the nozzles by way of the pressure chambers. The actuator unit has a plurality of individual electrodes, each of which has a main electrode region formed in correspondence to the respective pressure chamber, and an auxiliary electrode region connected to the main electrode region. The actuator unit is fixed on the plane of the flow passage unit and changes the volume of the pressure chamber. The flat flexible cable has a plurality of terminals which are respectively electrically connected to the auxiliary electrode regions, and is configured such that a plurality of wires, which are respectively connected to the plurality of terminals, extend in a one direction. In the flow passage unit, the plurality of pressure chambers, which are of a parallelogram shape in plan view having two acute angle portions and which are arranged along the direction crossing the one direction, are arranged so as to be parallel to each other. In the actuator unit, the individual electrodes, in which the main electrode regions are disposed opposing the pressure chambers, form a plurality of individual electrode rows which are parallel to each other. In each individual electrode row, the individual electrodes whose auxiliary electrode regions are located closer to the tip-end side of the flat flexible cable than are the main electrode regions and the individual electrodes whose auxiliary electrode regions are located closer to the base-end side of the flat flexible cable than are the main electrode regions are alternately disposed. Accordingly, widths and pitches of the wires connected to the respective terminals formed in correspondence to every individual electrode row can be equally increased in the entire region. Therefore, fabrication of the flat flexible cable is further facilitated. As a result, the pressure chambers can be arranged at high density.

BRIEF DESCRIPTION OF THE DRAWINGS

FIGS. 7A and 7B show an actuator unit of an inkjet head according to an embodiment, wherein FIG. 7A is an enlarged view of the region enclosed by a dashed line in FIG. 6, and FIG. 7B is a plan view of an individual electrode;

DESCRIPTION OF THE PREFERRED EMBODIMENTS

Hereinafter, preferable embodiments of the invention will be described by reference to the drawings.

Figure 1:
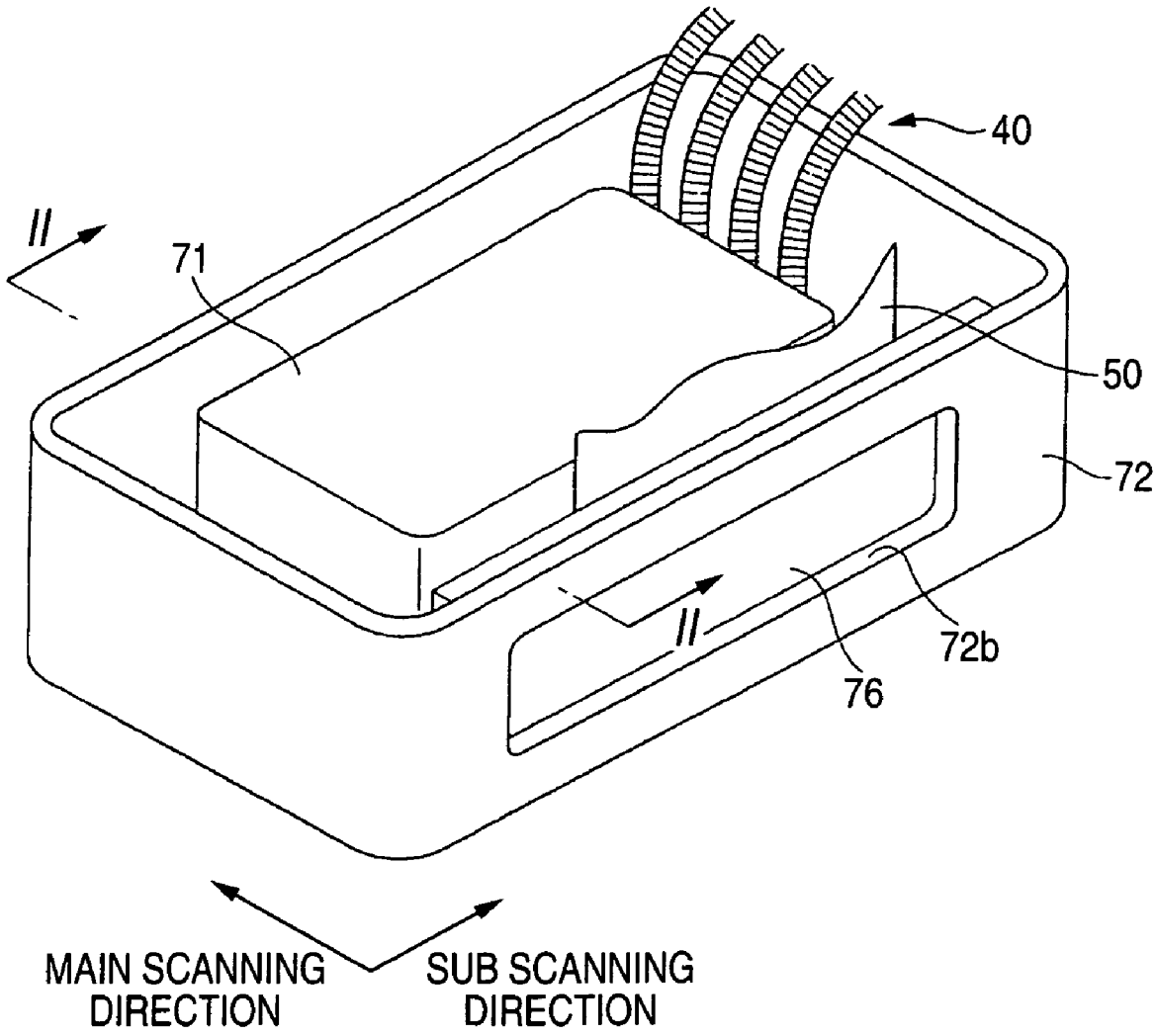
FIG. 1 is an external perspective view of an inkjet head according to first embodiment of the invention.
Figure 2:
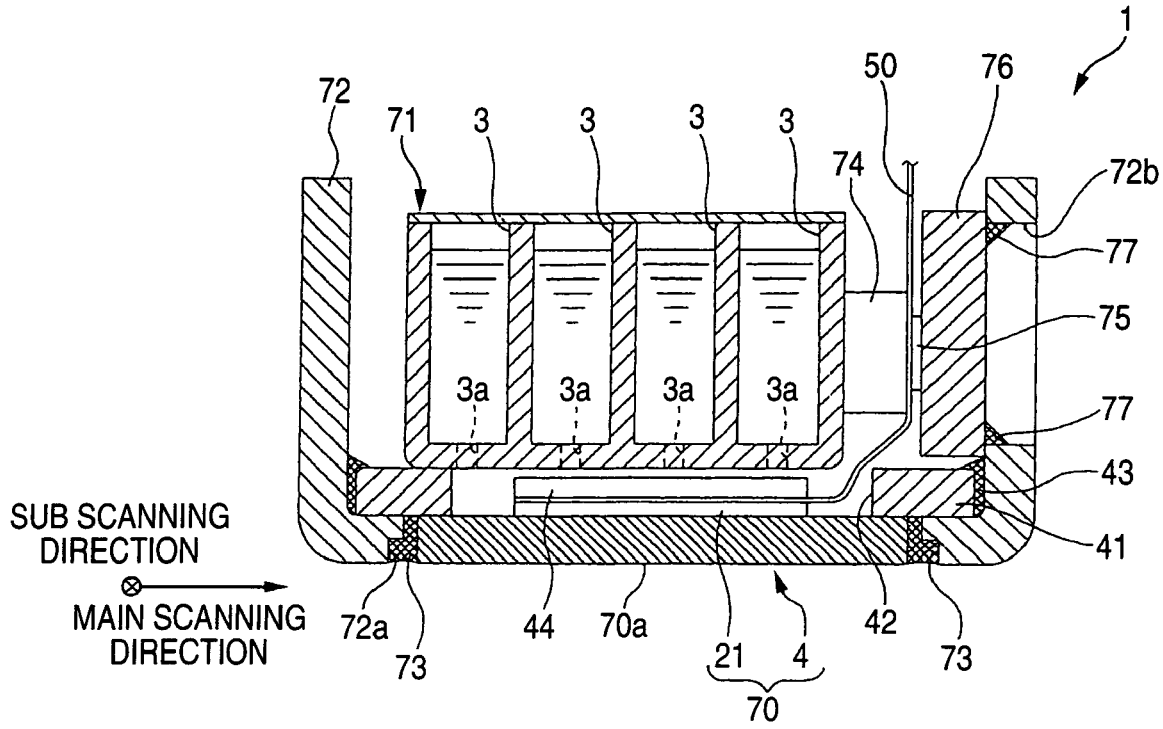
FIG. 2 is a cross-sectional view taken along line II-II of FIG. 1.
Figure 3:
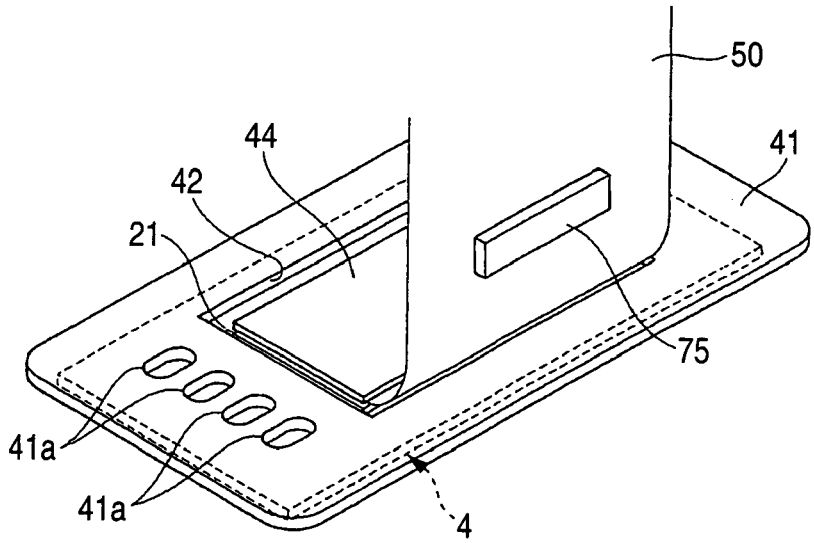
FIG. 3 is a perspective view showing a state where a reinforcement plate is bonded onto a head main body shown in FIG. 2.

FIG. 1 is an external perspective view of the inkjet head according to an embodiment of the invention. FIG. 2 is a cross-sectional view taken along line II-II of FIG. 1, showing a state where a head main body is assembled in a holder constituting the inkjet head. FIG. 3 is a perspective view showing a state where a reinforcement plate is affixed onto the head main body shown in FIG. 2. The inkjet head 1 is employed in a serial-type inkjet printer (not shown) for ejecting four-color ink consisting of magenta, yellow, cyan, and black onto a sheet which has been transported parallel to the sub scanning direction. As shown in FIGS. 1 and 2, the inkjet head 1 includes an ink tank 71 in which four ink chambers 3 for storing four colors of ink, respectively, and a head main body 70 which is disposed below the ink tank 71.

The four ink chambers 3 are formed along the main scanning direction inside the ink tank 71. Inks of magenta, yellow, cyan, and black are stored, in the above-listed order from the left-hand side of the ink chamber 3 in FIG. 2. Corresponding ink cartridges (not shown) are respectively connected to the four ink chambers 3 by way of tubes 40 (see FIG. 1), whereby the respective color inks are supplied to the ink chambers 3 from the ink cartridges. In addition, the ink tank 71 is assembled onto the reinforcement plate 41 of a rectangular shape in its plane as shown in FIGS. 2 and 3. The reinforcement plate 41 is fixed onto a holder 72 of a substantially rectangular solid shape by an ultraviolet curing agent 43. Furthermore, as shown in FIG. 3, an opening 42 of a rectangular shape in its plane is formed in the reinforcement plate 41. The head main body 70 is affixed to the holder 72 so as to allow disposal of an actuator unit 21 in the opening 42. The actuator unit 21 will be described later. Four ink outlet ports 3*a* which communicate with the four ink chambers 3, respectively, are formed at the lower end of the ink tank 71. Meanwhile, as shown in FIG. 3, four through holes 41*a* of an elliptical shape in plan view which are respectively connected to the four ink outlets 3*a* are formed in the reinforcement plate 41.

The head main body 70 includes a flow passage unit 4 in which a plurality of ink passages for the respective colors are formed, and the actuator unit 21 which is affixed onto the upper surface of the flow passage unit 4 by an epoxy heat-hardening adhesive. The flow passage unit 4 and the actuator unit 21 are configured by laminating a plurality of thin plates and bonding them to each other. The flow passage unit 4 and the actuator unit 21 are disposed below the ink tank 71. In the upper surface of the flow passage unit 4, four ink supply ports 4*a* (see FIG. 4) of an elliptical shape in plan view are formed. As shown in FIG. 3, the flow passage unit 4 is affixed to the reinforcement plate 41 such that the through holes 41*a* formed in the reinforcement plate 41 and the ink supply ports 4*a* formed in the flow passage unit 4 are respectively connected. By virtue of the above configuration, the four types of ink in the ink tank 71 are supplied into the flow passage unit 4 from the four corresponding ink supply ports 4*a* in the flow passage unit 4 by way of the four ink outlet ports 3*a* formed in the ink tank 71 and the four through holes 41*a* formed in the reinforcement plate 41.

The head main body 70 is, in a state where an ink ejection face 70*a* of the flow passage unit 4 is exposed to the outside, attached to a stepped opening 72*a* formed on the lower surface of the holder 72. A sealing agent 73 seals a space between the holder 72 and the flow passage unit 4. The bottom of the head main body 70 is formed into the ink ejection face 70*a* on which a number of nozzles 8 (see FIG. 6) having micro diameters are arrayed. In addition, a flexible printed circuit (FPC) 50 serving as an electricity-feeding member is connected on the upper surface of the actuator unit 21. The FPC 50 extends in one direction of the main scanning direction and extends upward while being bent. A protection plate 44 for protecting the FPC 50 and the actuator unit 21 is affixed on the upper surface of the portion of the FPC 50 opposing the actuator unit 21.

The FPC 50 connected to the actuator unit 21 extends along the side face of the ink tank 71 with an elastic member 74, such as sponge, disposed therebetween. A driver IC 75 is disposed on the FPC 50. Meanwhile, the FPC 50 is electrically connected by soldering so as to allow transmission of a drive signal output from the driver IC 75 to the actuator unit 21 (to be described in detail later) of the head main body 70.

In FIG. 2, an opening 72*b* for dissipating heat from the driver IC 75 to the outside is formed in the side wall of the holder 72 opposing the driver IC 75. In addition, a heat sink 76 of a substantially rectangular solid shape and made of an aluminum plate is disposed between the driver IC 75 and the opening 72*b* in the holder 72 such that the heat sink 76 is in close contact with the driver IC 75. By virtue of the heat sink 76 and the opening 72*b*, heat generated by the driver IC 75 can be effectively dissipated. Furthermore, a sealing agent 77 for filling a gap between the side wall of the holder 72 and the heat sink 76 is disposed in the opening 72*b*, thereby preventing intrusion of dust and ink into a main body of the inkjet head 1.

Figure 4:
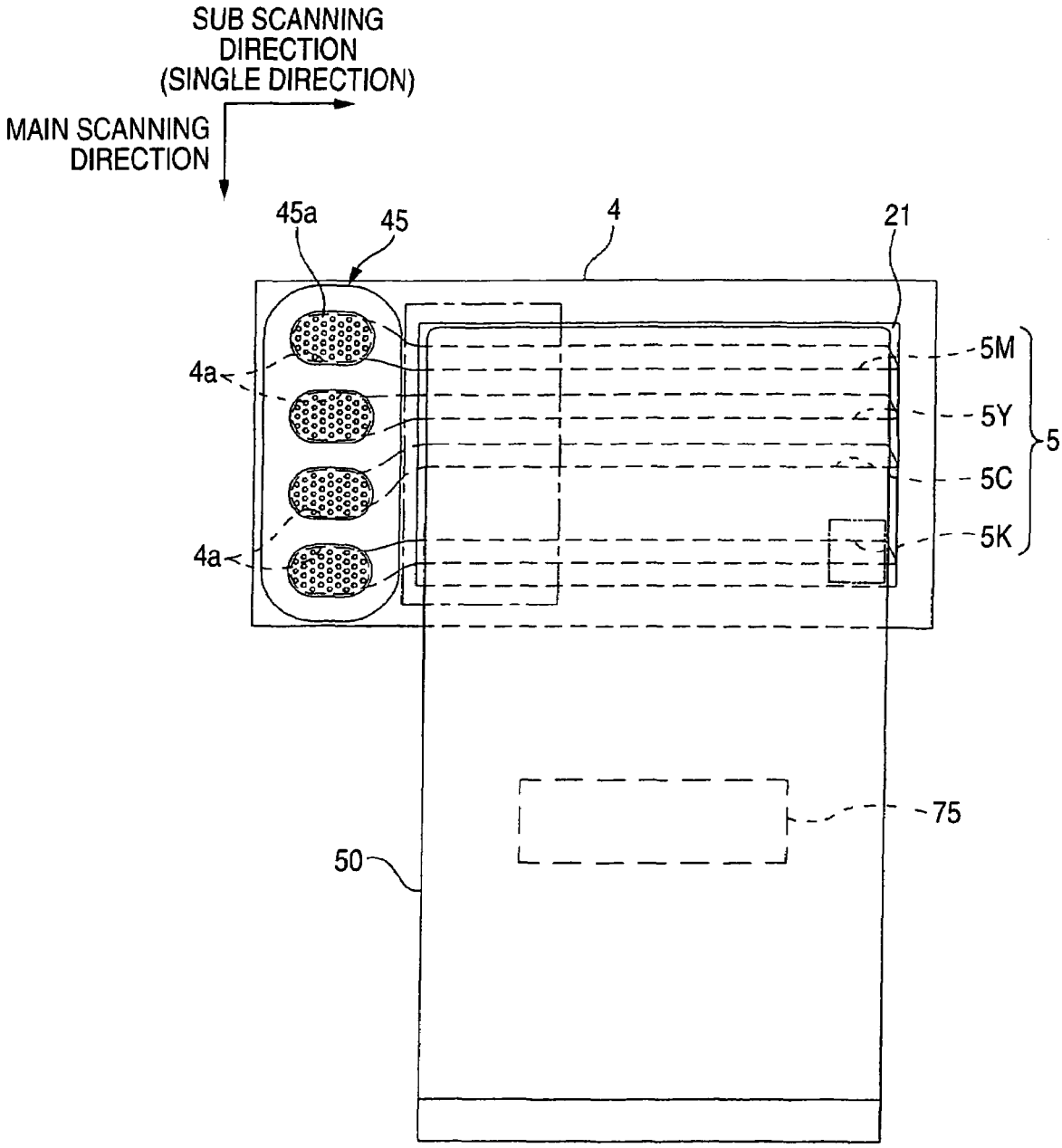
FIG. 4 is a plan view of the head main body.

FIG. 4 is a plan view of the head main body 70. As shown in FIG. 4, the head main body 70 has a rectangular shape in plan view extending in a direction of the flow passage unit 4 (the sub scanning direction). In FIG. 4, four manifold flow passages 5 extending parallel to each other along the longitudinal direction of the flow passage unit 4 are formed in the flow passage unit 4. Ink is supplied to the manifold flow passages 5 from the ink chambers 3 in the ink tank 71 by way of the four ink supply ports 4*a* in the flow passage unit 4. In the embodiment, manifold flow passages 5M, 5Y, 5C, and 5K, which correspond to magenta, yellow, cyan, and black, respectively, are formed in the above-listed order from the manifold flow passage 5 at the top side of FIG. 4 to the bottom side of the same. In addition, a filter member 45 is disposed at a position on the upper surface of the flow passage unit 4 and covers the four ink supply ports 4*a*. The filter member 45 has a filter 45*a* on which a plurality of micropores are formed at positions coinciding with the respective ink supply ports 4*a*. Thus, dust or the like in an ink flowing into the flow passage unit 4 from the ink tank 71 is trapped by the filter 45*a* of the filter member 45.

The actuator unit 21 of a rectangular shape in plan view is affixed onto a substantially center of the upper surface of the flow passage unit 4 not overlapping the ink supply ports 4*a* in a plan view. The lower surface of the flow passage unit 4 corresponding to a bonding region between the actuator unit 21 and the flow passage unit 4 is made an ink ejection region on which the number of nozzles 8 (see FIG. 6) are arrayed. A number of pressure chambers 10 (see FIG. 6) arrayed in a matrix are formed at the bonding region of the flow passage unit 4 opposing the actuator unit 21. In other words, the actuator unit 21 is of sufficient length to extend over all the pressure chambers 10.

Figure 5:
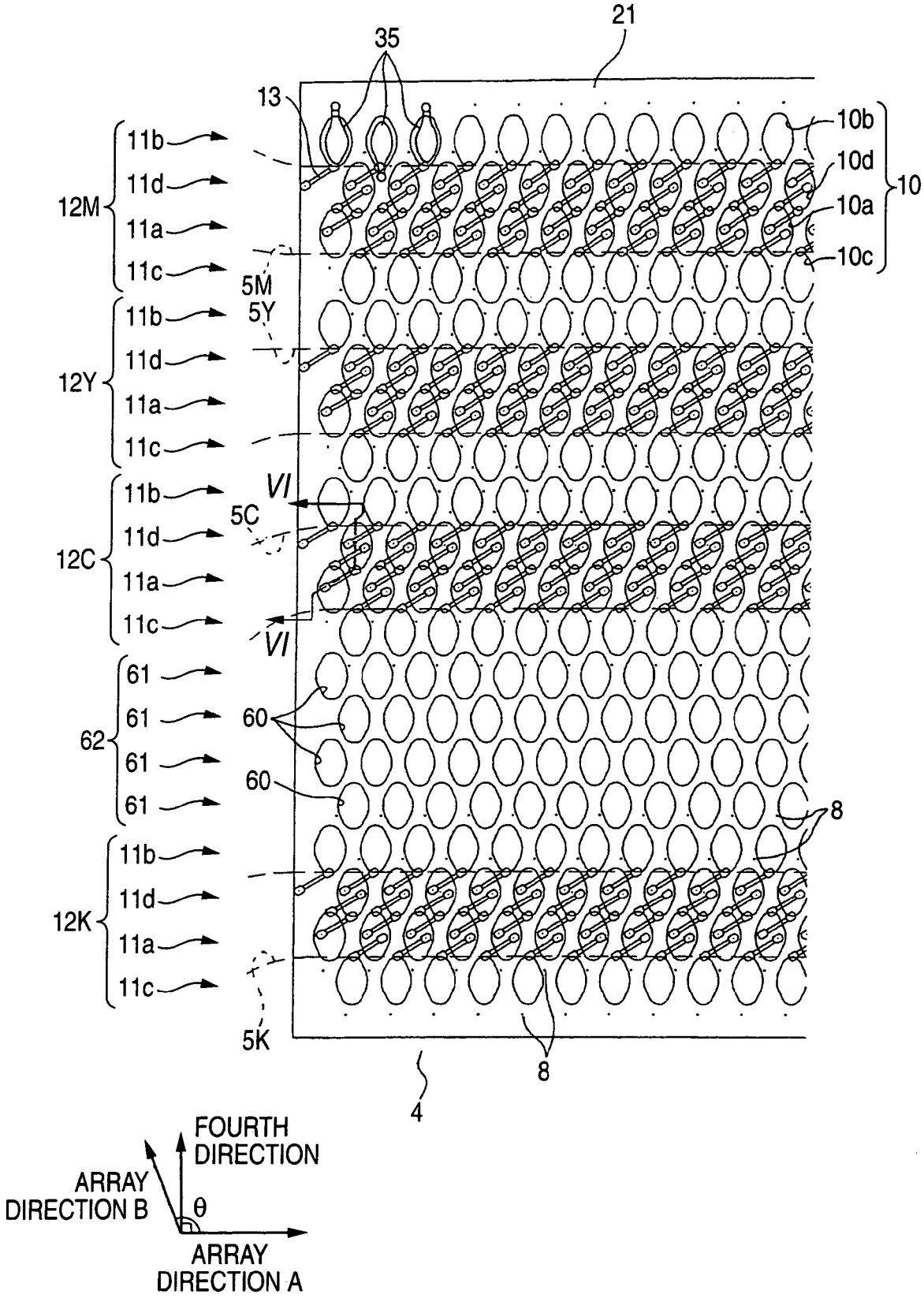
FIG. 5 is an enlarged view of the region enclosed with a dashed line in FIG. 4.

FIG. 5 is an enlarged view of the region enclosed with a dashed line in FIG. 4. The pressure chamber 10 formed in the flow passage unit 4 is of a substantially rhombic shape whose corners are rounded. The longer diagonal line is parallel to the width direction of the flow passage unit 4 (the main scanning direction). One end of each of the pressure chambers communicates with the nozzle 8, and the other end communicates with the respective manifold flow passage 5 by way of a corresponding aperture 13. A number of individual flow passages 7 (see FIG. 6) which are formed for the respective pressure chambers and which communicate with the nozzles 8 are connected to the respective manifold flow passages 5. In FIG. 5, the pressure chambers 10, the apertures 13, the nozzles 8, and the like, which are inside the flow passage unit 4 and are to be depicted with dotted lines, are depicted with solid lines for the sake of easy understanding of the drawings.

Figure 6:
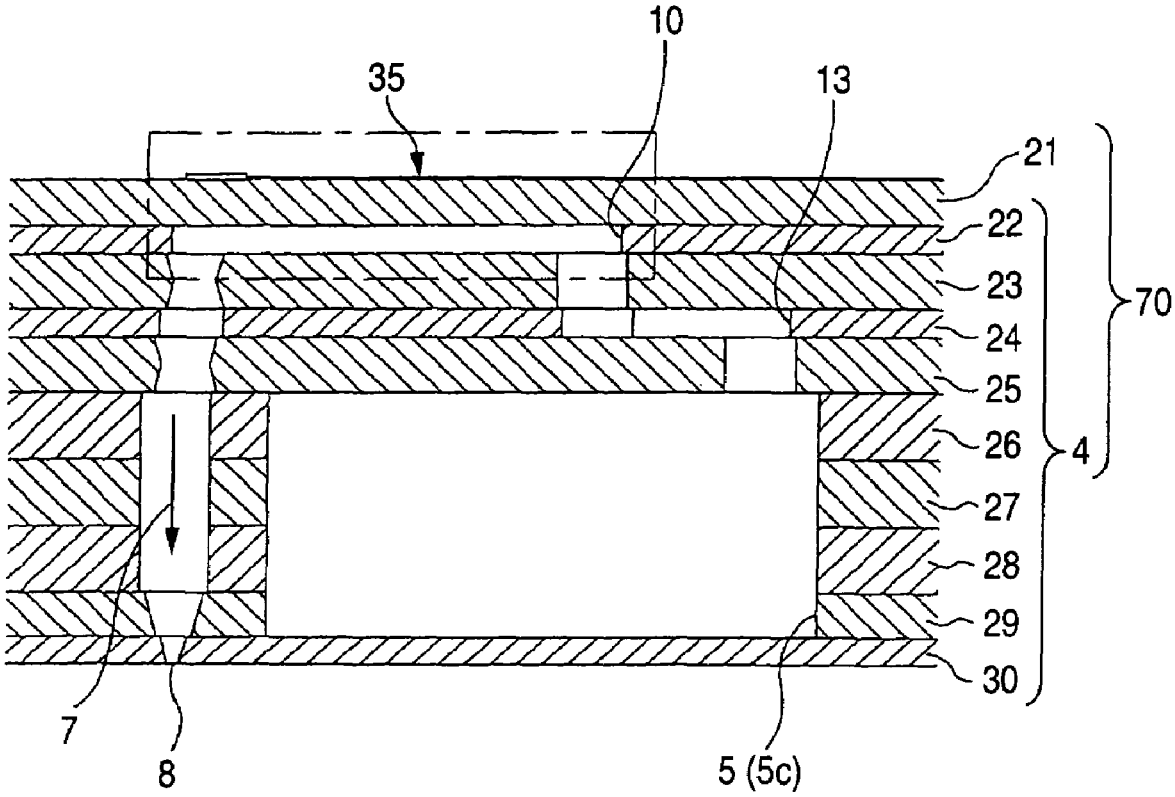
FIG. 6 is a cross-sectional view taken along line VI-VI of FIG. 5.

FIG. 6 is a cross-sectional view showing individual ink flow passages, and is a cross-sectional view along VI-VI of FIG. 5. Each of the apertures 13 communicates with one acute angle section of the pressure chamber 10; and the corresponding nozzle 8 for ejecting ink communicates with the other acute angle section of the same. As is indicated in FIG. 6, the respective nozzles 8 configure flow passages corresponding to the pressure chambers 10 by communicating with the manifold flow passages 5 by way of the pressure chambers 10 and apertures (i.e., restriction) 13. Thus, the plurality of ink flow passages 7 serving as flow passages for the respective pressure chambers 10 are formed in the head main body 70.

The head main body 70 has a layered structure in which, as shown in FIG. 6, ten sheet materials in total are laminated; i.e., from the upper side, the actuator unit 21, a cavity plate 22, a base plate 23, an aperture plate 24, a supply plate 25, manifold plates 26 to 29, and a nozzle plate 30. Of the above, the nine plates other than the actuator unit 21 form the flow passage unit 4.

As will be described later in detail, the actuator unit 21 is configured by laminating four piezoelectric sheets 41 to 44 (see FIG. 7A). Of the four sheets, only the top-most layer is a layer including portions which serve as active sections when an electric field is applied thereto (hereinafter, simply referred to as "layer including active sections") and the remaining three layers are inactive layers. The cavity plate 22 is a metal plate, in which a number of substantially rhombic holes for forming voids of the pressure chambers 10 are formed within a range where the actuator unit 21 is affixed. The base plate 23 is a metal plate, in which, for each of the pressure chambers 10 in the cavity plate 22, a communication hole for connecting the pressure chamber 10 with an aperture 13, and another communication hole for connecting the pressure chamber 10 with the nozzle 8 are disposed.

The aperture plate 24 is a metal plate, in which a communication hole for connecting the pressure chamber 10 with the nozzle 8 and a hole serving as the aperture 13 are disposed for each of the pressure chamber 10 in the cavity plate 22. The supply plate 25 is a metal plate, in which a communication hole for connecting the aperture 13 with the manifold flow passage 5 and another communication hole for connecting the pressure chamber 10 with the nozzle 8 are disposed for each of the pressure chambers 10 in the cavity plate 22. Each of manifold plates 26 to 29 is a metal plate, in which a communication hole for connecting the pressure chamber 10 with the nozzle 8, in addition to the manifold flow passage 5, is disposed for each of the pressure chambers 10 in the cavity plate 22. The nozzle plate 30 is a metal plate, in which the nozzle 8 is disposed for each of the pressure chambers 10 in the cavity plate 22.

The ten sheets 21 to 30 are laminated while being positioned with each other so as to form the individual ink flow passage 7 as shown in FIG. 6. The individual ink flow passage 7 first extends upward from the manifold flow passage 5, then extends horizontally in the aperture 13, then further extends upward, then again extends horizontally in the pressure chamber 10, then extends obliquely downward in a certain length away from the aperture 13, and then extends vertically downward toward the nozzle 8.

As is apparent in FIG. 6, the pressure chamber 10 and the aperture 13 are provided at different levels in the lamination direction of the plates. By virtue of the above configuration, within the flow passage unit 4 opposing the actuator unit 21, the aperture 13 communicating with a pressure chamber 10 can be disposed at the same position in its plan view as another pressure chamber 10 which is adjacent to the pressure chamber 10 as shown in FIG. 5. As a result, because the pressure chambers 10 are arranged close to each other at high density, image printing of a high resolution can be achieved with an inkjet head 1 having a relatively small occupation area.

Returned to FIG. 5, each of the plurality of pressure chambers 10 communicates with the corresponding nozzle 8 at one end of the longer diagonal line, and the other end thereof communicates with the respective manifold flow passage 5 by way of the aperture 13. As will be described later, individual electrodes 35 (see FIG. 7B) each having a substantially rhombic shape in plan view and of a smaller size than the pressure chamber 10 are arranged in a matrix so as to oppose the pressure chambers 10. Meanwhile, FIG. 5 depicts, for the sake of simplifying the drawing, only some of the plurality of individual electrodes 35.

The pressure chambers 10 are adjacently disposed in a matrix in two directions of an array direction A (a first direction) and an array direction B (a second direction), and a plurality of pressure chambers 10 are formed along the array direction A in a staggered array pattern. The array direction A is a longitudinal direction of the inkjet head 1; that is, a direction along which the flow passage unit 4 extends, which is parallel to a shorter diagonal line of the pressure chamber 10. The array direction B is an oblique direction forming an obtuse angle with the array direction A of the pressure chamber 10. In addition, two acute angle portions of the pressure chamber 10 are located between other two pressure chambers which are adjacent thereto.

The pressure chambers 10, which are adjacently disposed in a matrix in two directions of the array directions A and B, are disposed along the array direction A so as to have gaps therebetween corresponding to the resolution. For instance, in the embodiment, adjacent pressure chambers 10 are separated from each other by a distance corresponding to 37.5 dpi along the array direction A so as to enable printing at a resolution of 150 dpi. In addition, 16 pressure chambers 10 are arranged along the array direction B in the actuator unit 21, and 8 pressure chambers 10 are arranged along a direction (a fourth direction) perpendicular to the array direction A when viewed from a direction (a third direction) perpendicular to the sheet plane of FIG. 5.

The number of pressure chambers 10 arranged in a matrix forms a plurality of pressure chamber rows 11 each extending along the array direction A shown in FIG. 5. The plurality of pressure chamber rows 11 are, when viewed from the third direction, grouped into a first pressure chamber row 11*a*, a second pressure chamber row 11*b*, a third pressure chamber row 11*c*, and a fourth pressure chamber row 11*d* corresponding to relative positions to the respective manifold flow passages 5. The first to fourth pressure chamber rows 11*a* to 11*d* are arranged from one side of the actuator unit 21 to the other side in its width direction (from the bottom side to the top side in FIG. 5) in the order of 11*c*→11*a*→11*d*→11*b*→11*c*→11*a*→(repeated)→11*b* in a cycle constituted of the four pressure chamber rows. Meanwhile, every four pressure chamber rows of the first to fourth pressure chamber rows, which are arranged cyclically, form a pressure chamber group, whereby four pressure chamber groups 12 are formed. The pressure chambers 10 of the respective pressure chamber groups 12 communicate with the respective manifold flow passages 5 by way of the apertures 13. In other words, the respective pressure chamber groups 12 are formed for the respective manifold flow passages 5, whereby the pressure chamber groups 12 are grouped into pressure chamber groups 12M, 12Y, 12C, and 12K so as to correspond to the four color inks. The pressure chambers 10 belonging to the respective four pressure chamber groups 12M, 12Y, 12C, and 12K are changed in volume by the actuator unit 21, whereby the four color ink can be ejected from the nozzles 8 communicating with the respective pressure chamber groups 12.

In pressure chambers 10*a* constituting the first pressure chamber row 11*a* and pressure chambers 10*c* constituting the third pressure chamber row 11*c*, the nozzles 8 are offset to the bottom side in the sheet plane of FIG. 5 in relation to the direction (the fourth direction) perpendicular to the array direction A when viewed from the third direction. In addition, the nozzles 8 are adjacent to the vicinity of the left sides of the lower ends of the respectively corresponding pressure chambers 10 in plan view of FIG. 5. Meanwhile, in pressure chambers 10*b* constituting the second pressure chamber row 11*b* and pressure chambers 10*d* constituting the fourth pressure chamber row 11*d*, the nozzles 8 are offset to the upper side in the sheet plane of FIG. 5 in relation to the fourth direction. The nozzles 8 are adjacent to the vicinity of the right sides of the upper ends of the corresponding pressure chambers 10 in the plan view of FIG. 5. In the first and fourth pressure chamber rows 11*a*, 11*d*, at least half the areas of the pressure chambers 10*a*, 10*d* overlap the manifold flow passages 5 when viewed from the third direction. In the second and third pressure chamber rows 11*b*, 11*c*, approximately the entire area of the pressure chambers 10*b*, 10*c* do not overlap the manifold flow passages 5 when viewed from the third direction. As a result, ink can be smoothly supplied to the respective pressure chambers 10 belonging to any of the pressure chamber rows, by expanding widths of the manifold flow passages 5 as much as possible while preventing the nozzles 8 communicating with the pressure chambers 10 from overlapping the manifold flow passages 5*a*.

A plurality of voids 60 are formed in the cavity plate 22 in the flow passage unit 4 at positions between the manifold flow passages 5C and 5K in plan view. The plurality of voids 60 are, as in the case of the pressure chambers 10, adjacently disposed along two directions of the array directions A and B. The plurality of voids 60 along the array direction A form four void rows 61 which are parallel to each other. The four void rows 61 constitute a void group 62. The plurality of voids 60 in the void group 62 are defined by holes having the same shape and size as the pressure chamber 10 formed in the cavity plate 22 being sealed by the actuator unit 21 and the base plate 23. More specifically, since ink flow passages do not communicate with the voids 60, the plurality of voids 60 are never filled with ink. In addition, on the ink ejection face 70*a* on the flow passage unit 4, nozzles communicating with the voids 60 are not formed at positions opposing the void group 62. Accordingly, an ink ejection region formed on the ink ejection face 70*a* is divided into a black region for ejecting black ink and a color region for ejecting ink of magenta, yellow, and cyan. Since the ink ejection region is divided into the color region and black region as described above, a cap for purging only black ink can be easily disposed. Meanwhile, the reason why the void group 62 is formed in the cavity plate 22 is to improve ink ejection characteristics by providing uniform rigidity against the pressure chambers 10.

Next, the configuration of the actuator unit 21 will be described. A number of the individual electrodes 35 are disposed in a matrix in the same array pattern as the pressure chambers 10 on the actuator unit 21. The respective individual electrodes 35 are disposed at positions opposing the pressure chambers 10 in plan view. Thus, when the plurality of pressure chambers 10 and the individual electrodes 35 are regularly arranged, design can be facilitated.

Figure 7A:
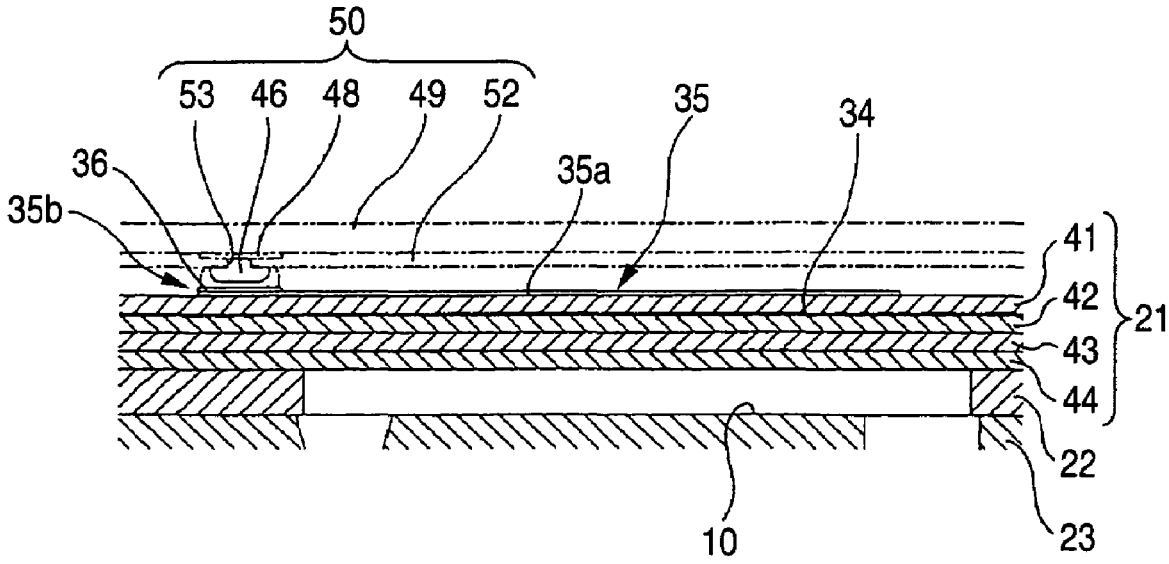
Figure 7B:
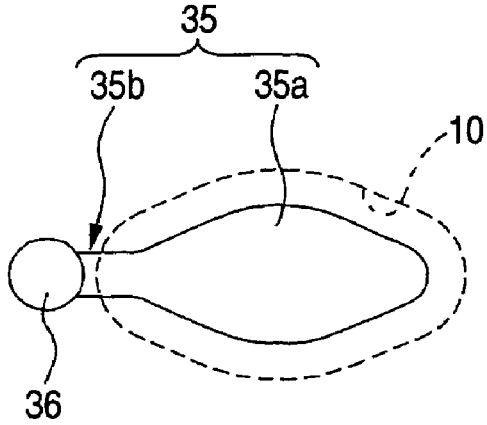
Figure 8:
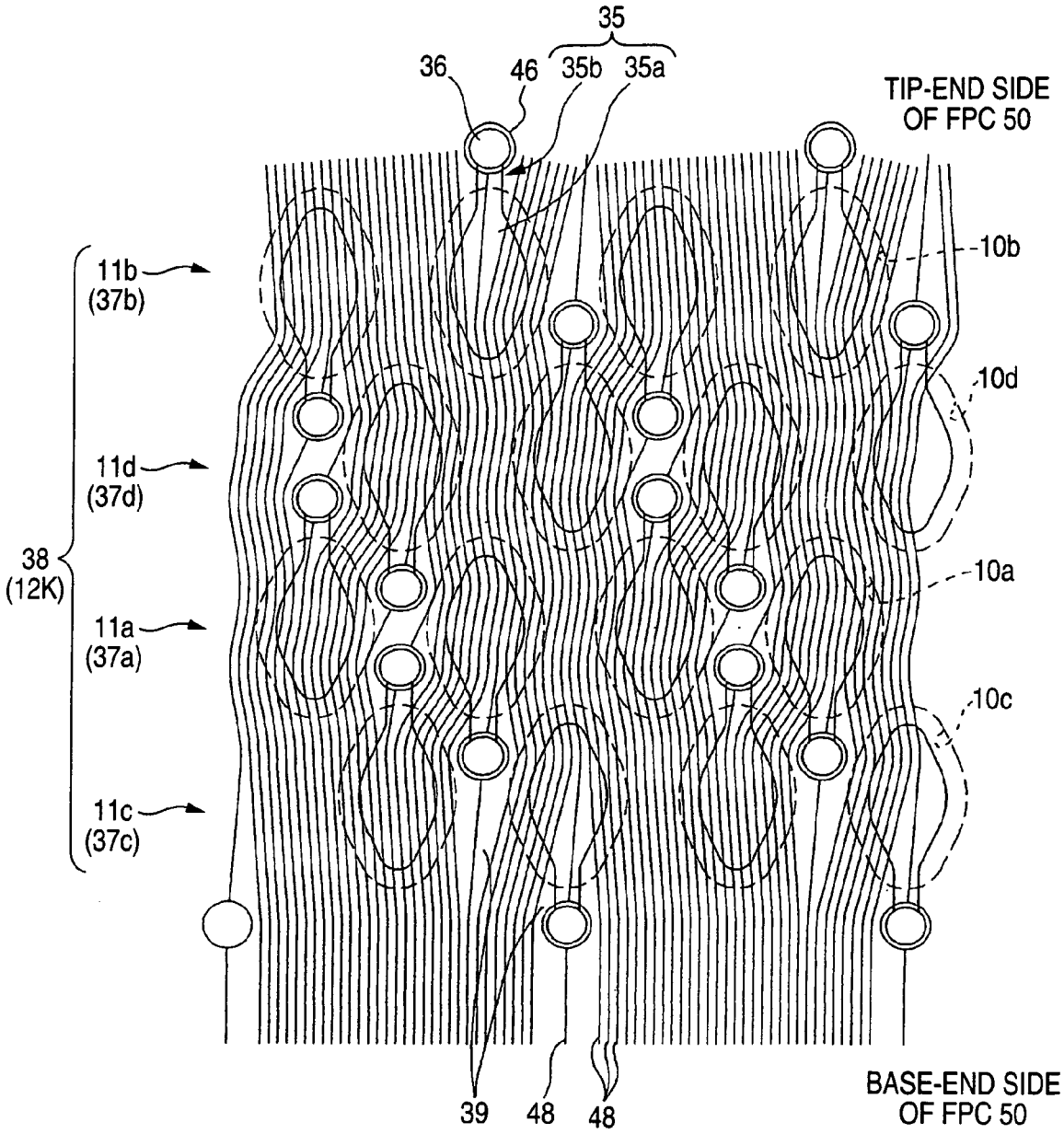
FIG. 8 is an enlarged view of the region enclosed by an alternate long and short dashed line shown in FIG. 4, wherein an array pattern of a plurality of individual electrode rows 37 formed by individual electrodes 35 according to first embodiment of the invention is shown.

FIGS. 7A and 7B show the actuator unit. FIG. 7A is an enlarged view of the region enclosed with a dashed line in FIG. 6. FIG. 7B is a plan view of the individual electrode. FIG. 8 is an enlarged view of the region enclosed with an alternate long and short dash line shown in FIG. 4. Meanwhile, in FIG. 7A, the FPC 50 electrically connected to the respective individual electrodes 35 is depicted with alternate long and short dash lines. In addition, for the sake of easy understanding of FIG. 8, the individual electrodes 35 of the actuator unit 21 and terminals 46 and wires 48 of the FPC 50, which are originally to be depicted with broken lines, are depicted with solid lines. As shown in FIGS. 7A, 7B, the individual electrode 35 is disposed at a position opposing the pressure chamber 10. In plan view, the individual electrode 35 is configured by a main electrode region 35*a* formed in a plane region of the pressure chamber 10 and an auxiliary electrode region 35*b* which is connected to the main electrode region 35*a* and which is formed outside the plane region of the pressure chamber 10.

As shown in FIG. 7A, the actuator unit 21 includes the four piezoelectric sheets 41, 42, 43, and 44, each having a thickness of about 15 μm. These piezoelectric sheets 41 to 44 are made into a continuous layered flat plate (continuous flat plate layers) that is disposed so as to extend over a number of pressure chambers 10 formed within the ink ejection region in the inkjet main body 70. Since the piezoelectric sheets 41 to 44 are disposed to extend over the number of pressure chambers 10 as continuous flat plate layers, the individual electrodes 35 can be arranged at high density by using, for instance, a screen printing technique. As a result, the pressure chambers 10 formed at positions corresponding to the individual electrodes 35 can also be arranged at high density, thereby enabling printing of a high-resolution image. The piezoelectric sheets 41 to 44 are made of a lead zirconate titanate (PZT) ceramic material exhibiting ferroelectricity.

The main electrode region 35*a* of the individual electrode 35 formed on the top-most piezoelectric sheet 41 has, as shown in FIG. 7B, a substantially rhombic shape in plan view which is approximately analogous to that of the pressure chamber 10. One of the acute angle portions of the main electrode region 35*a* of the substantially rhombic shape extends to connect with the auxiliary electrode region 35*b*. At the tip end of the auxiliary electrode region 35*b*, a circular land 36, which is electrically connected with the individual electrode 35, is disposed. As shown in FIG. 7A, the land 36 opposes a region of the cavity plate 22 where the pressure chambers 10 are not formed. The land 36 is made of, e.g., gold-containing glass frit. As shown in FIG. 7A, the land 36 is formed on the surface of the auxiliary electrode 35*b*.

As shown in FIG. 8, the plurality of individual electrodes 35 form a plurality of individual electrode rows 37 which are arranged in parallel to each other along the array direction A in a similar manner as the pressure chamber rows 11. The plurality of individual electrode rows 37 are grouped into individual electrode rows 37*a* to 37*d* corresponding to the pressure chamber rows 11*a* to 11*d*. The individual electrode rows 37*a* to 37*d* form a group, whereby four individual electrode groups 38 corresponding to the four pressure chamber groups 12 are formed. Each of the individual electrode rows 37 includes individual electrodes 35 in which the auxiliary electrode regions 35*b* are formed on the base-end side (the bottom side in FIG. 8 where the driver IC is formed) of the FPC 50 in relation to the main electrode regions 35*a*, and individual electrodes 35 in which the auxiliary electrode regions 35*b* are formed on the tip-end side (the top side in FIG. 8 which is opposite to the side where the driver IC is formed) of the FPC 50 in relation to the main electrode region 35*a*. In each of the individual electrode rows 37, the auxiliary electrode regions 35*b* of the individual electrodes 35 are alternately disposed along the array direction A so as to face either the base-end side or the tip-end side of the FPC 50. In addition, in each of the individual electrode groups 38, the auxiliary electrode regions 35*b* of the individual electrodes 35 are disposed along the array direction B so as to face either the base-end side or the tip-end side of the FPC 50 alternately.

Returning to FIG. 7A, a common electrode 34 having the same outer shape as that of the piezoelectric sheet 41 and a thickness of substantially 2 μm is interposed between the top-most piezoelectric sheet 41 and the piezoelectric sheet 42 located immediately below the same. Both the individual electrodes 35 and the common electrode 34 are made of a metal material of, e.g., an Ag—Pd alloy.

The common electrode 34 is grounded at an unillustrated region. Accordingly, the common electrode 34 is maintained at an equally uniform potential, in the embodiment, at the ground potential, at regions corresponding to all the pressure chambers 10.

As shown in FIG. 7A, the FPC 50 includes a base film 49, a plurality of wires 48 formed on the lower surface of the base film 49, and a cover film 52 covering substantially the entire area of the lower surface of the base film 49. The base film 49 has a thickness of approximately 25 μm, the wires 48 have a thickness of approximately 9 μm, and the cover film 52 has a thickness of approximately 20 μm. A plurality of through holes 53 each having an smaller diameter than a width of a wire 48 are formed in the cover film 52 corresponding to the lands 36 formed in the actuator unit 21. The base film 49, the wires 48, and the cover film 52 are laminated while being positioned with each other so that the centers of the respective through holes 53 coincide with the center lines of wires 48, and so that the peripheral edges of the wires 48 are covered with the cover film 52. The terminals 46 of the FPC 50 are connected to the wires 48 by way of the through-holes 53.

Both the base film 49 and the cover film 52 are sheet members having an insulating characteristic. In the embodiment, the base film 49 is made of a polyimide resin; and the cover film 52 is made of a photosensitive material. By making the cover film 52 from such a photosensitive material as in the embodiment, fabrication of a number of through holes 53 is facilitated.

The wires 48 are made of copper foil. The wires 48 are wires connected to the driver IC 75, and form a predetermined pattern on the lower surface of the base film 49.

The terminals 46 are made of a conductive material of, e.g., nickel. The terminals 46 are formed such that the terminals 46 plug the through holes 53, cover the peripheral edges around the through-holes 53, and protrude out of the lower surface of the cover film 52. The terminals 46 have a diameter of approximately 5 μm and a thickness of approximately 30 μm when measured from the lower surface of the cover film 40.

As shown in FIG. 8, the plurality of terminals 46 of the FPC 50 are disposed at positions opposing the lands 36 of the individual electrodes 35, and are configured such that each of the terminals 46 can be connected to a single land 36. From the respective terminals 46, the wires 48 extend in one direction toward the base-end side and in one direction toward the tip-end side of the FPC 50 (i.e., the width direction of the flow passage unit 4, which is the main scanning direction). The respective terminals 46 are independently connected to the driver IC 75 by way of the wires 48 extending to the base-end side of the FPC 50. Accordingly, the potential of each pressure chamber 10 can be controlled independently. Meanwhile, in the FPC 50 of the embodiment, the wires 48 extend toward the base-end side and the tip-end side of the FPC 50 from the terminals 46 for the purpose of applying soldering plating by electrolytic galvanization for allowing the terminals 46 of the FPC 50 to be connected with the lands 36. After the soldering plating is applied onto the respective terminals of the FPC 50, the tip-end portion of the FPC 50 is cut, leaving a portion opposing the actuator unit 21 of the FPC 50 (i.e., a region where the plurality of terminals 46 of the FPC 50 are formed), whereby the FPC 50 is formed into a form shown in FIG. 4.

Of the plurality of wires 48 extending from the respective terminals 46 of the FPC 50 at the periphery of an arbitrary one of terminals 46, the wires 48 other than the one extending from the arbitrary one of the terminals 46 are bent so as to form a wiring-free region 39 while skirting peripheral regions of the arbitrary one of the terminals 46. In addition, the wires 48 extending from the respective terminals 46 of the FPC 50 are disposed at substantially regular intervals at regions sandwiched between the peripheral regions of the terminals 46.

Next, a driving method of the actuator unit 21 will be described. The polarization direction of the piezoelectric sheet 41 in the actuator unit 21 is its thickness direction. More specifically, the actuator unit 21 has a so-called unimorph structure wherein the upper (i.e., distant from the pressure chamber 10) single piezoelectric sheets 41 is a layer including the active section, and the lower (i.e., close to the pressure chamber 10) three piezoelectric sheets 42 and 44 are inactive layers. Therefore, when either a predetermined positive or negative potential is applied to the individual electrode 35; for instance, in a case where the electric field and the polarization are in the same direction, the portion sandwiched between electrodes in the piezoelectric sheet 41 where the electric field is applied acts as an active section (a portion where a pressure is generated), which contracts in the direction perpendicular to the polarization direction by the transversal piezoelectric effect.

In the embodiment, the portion in the piezoelectric sheet 41 sandwiched between the individual electrode 35 and the common electrode 34 acts as the active section where distortion occurs by the piezoelectric effect upon application of the electric field. Meanwhile, since no electric field is applied onto the three piezoelectric sheets 42 to 44 below the piezoelectric sheet 41, the three sheets function little as active sections. Therefore, portions in the piezoelectric sheet 41 sandwiched between the main electrode region 35*a* and the common electrode 34 mainly contract in the direction perpendicular to the polarization direction by the transversal piezoelectric effect.

Meanwhile, the piezoelectric sheets 42 to 44, which are not affected by the electric field, are not displaced spontaneously. Accordingly, there develops a variation between distortion in the direction perpendicular to the polarization direction between the piezoelectric sheet 41 of the upper layer and the piezoelectric sheets 42 to 44 of the lower layers. Accordingly, the piezoelectric sheets 41 to 44 as a whole tend to deform so as to protrude toward the inactive side (unimorph deformation). At this time, as shown in FIG. 7A, the lower surface of the actuator unit 21 constituted of the piezoelectric sheets 41 to 44 is fixed to the upper surface of the partition (cavity plate) 22 which defines pressure chambers. As a result, the piezoelectric sheets 41 to 44 are deformed so as to protrude toward the pressure chamber side. Consequently, the volume of the pressure chamber 10 is decreased to raise the pressure of ink, whereby the ink is ejected from the nozzle 8. Thereafter, when the individual electrodes 35 is returned to the same potential as that of the common electrode 34, the piezoelectric sheets 41 to 44 return to their original shape, and the volume of the pressure chamber 10 returns to its original volume, whereby ink is sucked from the manifold flow passage 5 side.

As another driving method, the following method is also applicable. The individual electrodes 35 are set in advance at a potential different from that of the common electrode 34. Every time a request for ejection is issued, the individual electrodes 35 are temporarily set at the same potential as that of the common electrode 34; thereafter, at a predetermined timing, the individual electrodes 35 are again set at the potential different from that of the common electrode 34. In this case, at the timing when the individual electrodes 35 are set at the same potential as that of the common electrode 34, the piezoelectric sheets 41 to 44 return to their original shapes. Accordingly, the pressure chamber 10 is increased in volume from its initial state (a state where the potentials of electrodes differ from each other), whereby ink is sucked into the pressure chamber 10 from the manifold flow passage 5 side. Thereafter, at the timing when the individual electrodes 35 are again set at the potential different from that of the common electrode 34, the piezoelectric sheets 41 to 44 deform so as to protrude toward the pressure chamber 10 side. Accordingly, the volume of the pressure chamber 10 is decreased, and the pressure of ink in the pressure chamber 10 increases, whereby ink is ejected. Thus, ink is ejected from the nozzle 8, and the inkjet head 1 is moved in the main scanning direction as required. As a result, a desired image is printed on a sheet.

According to the above-described inkjet head 1, pitches between the plurality of wires 48 extending from the terminals 46 of the FPC 50 which are electrically connected with the plurality of individual electrodes 35 of the actuator unit 21 can be made relatively large. More specifically, as shown in FIG. 8, in the individual electrode row 37*c* of the actuator unit 21 which is the closest to the base-end side of the FPC 50, there are alternately included the individual electrodes 35 in which the auxiliary electrode regions 35*b* are located on the tip-end side of the FPC 50 in relation to the main electrode regions 35*a* and the individual electrodes 35 in which the auxiliary electrode regions 35*b* are located on the base-end side of the FPC 50 in relation to the main electrode regions 35*a*. Accordingly, a distance between the adjacent auxiliary electrode regions 35*b* is twice that of the configuration, as is disclosed in JP-A-2003-311953, wherein the adjacent auxiliary electrode regions 35*b* of the individual electrodes 35 are disposed to face a one direction. More specifically, when three individual electrodes 35 which are adjacent to each other in the individual electrode row 37*c* are taken as an example, an auxiliary electrode region 35*b* of an individual electrode 35 sandwiched between two individual electrodes 35, whose auxiliary electrode regions 35*b* are on the base-end side of the FPC 50 in relation to the main electrode regions 35*a*, is on the tip-end side of the FPC 50. Accordingly, in the direction parallel to the array direction A, the distance between the adjacent auxiliary electrode regions is increased. As a result, widths and pitches of the wires 48 which are connected to the respective terminals 46 of the FPC 50 and which are formed in correspondence to the individual electrodes 35, which are closest to the base end of the FPC 50, can be increased. Consequently, since the pitches between the wires 48 of the FPC 50 are increased, fabrication of the FPC 50 is facilitated. In addition, there is also negated an increase in pitches between lands 36 of the individual electrodes 35 by increasing the size of the actuator unit so as to increase pitches between the terminals 46 of the FPC 50 to be connected to the lands 36 while increasing pitches between the wires 48. Accordingly, an increase in the size of the inkjet head can also be prevented. Furthermore, demand for higher resolution of images or for increasing the density of the pressure chambers can be easily satisfied.

In all the individual electrode rows 37 formed in the actuator unit 21 of the inkjet head 1, the individual electrodes 35 whose auxiliary electrode regions 35*b* are located on the tip-end side of the FPC 50 in relation to the main electrode regions 35*a* and the individual electrodes 35 whose auxiliary electrode regions 35*b* are located on the base-end side of the FPC 50 in relation to the main electrode regions 35*a* are alternately disposed. Accordingly, widths and pitches of the wires 48 which are connected to the respective terminals 46 of the FPC 50 and which are formed in correspondence with all the individual electrode rows can be equally increased in the entire region. Accordingly, fabrication of the FPC 50 is further facilitated. In addition, the degree of flexibility in designing a plane shape of the pressure chamber group 12 constituted of a plurality of pressure chambers 10 is increased. More specifically, so long as the auxiliary electrode regions 35*b* are arranged alternately along the array direction A in every individual electrode row constituted of the individual electrodes 35, pitches between the lands 36 of the auxiliary electrode regions 35*b* are increased, regardless of the shape the pressure chamber group constituted of the plurality of pressure chambers 10 which respectively oppose the plurality of individual electrodes 35. Accordingly, pitches between the terminals 46 of the FPC 50 are also increased, and widths and pitches between wires 48 extending from the terminals 46 are also increased. Furthermore, in the embodiment, the wires 48 extend substantially perpendicular to the direction along which the individual electrode rows extend. This brings about an effect that a larger number of wires 48 can be disposed without decreasing widths or pitches between wires even when the equal width of the lands 36 is not changed.

Figure 9:
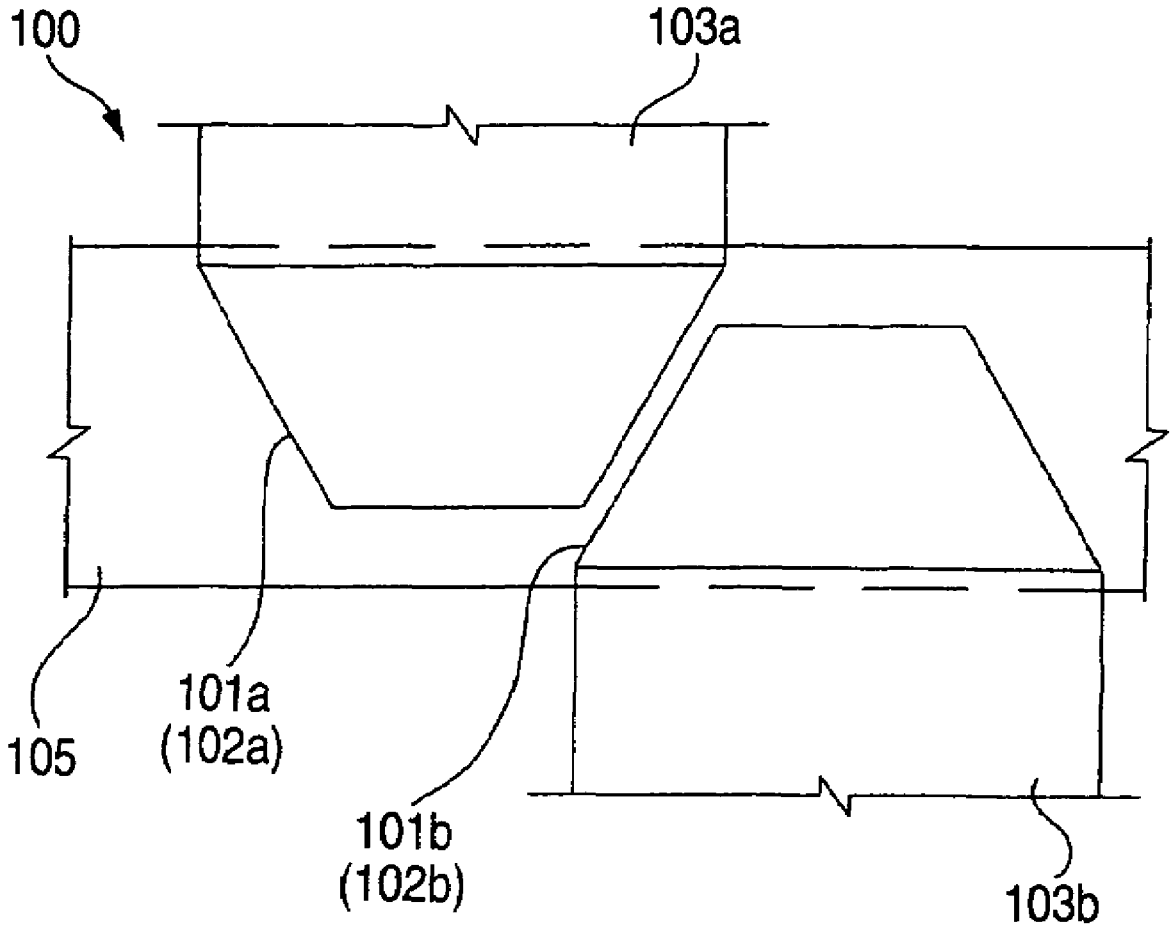
FIG. 9 is a plan view showing a modification of an inkjet head according to an embodiment of the invention.

Meanwhile, in the inkjet head 1 according to the embodiment, the plurality of individual electrode rows 37 which are constituted of the plurality of individual electrodes 35 and which are formed in the actuator unit 21 is configured such that the individual electrodes 35, whose auxiliary electrode regions 35*b* are located on the tip-end side of the FPC 50 in relation to the main electrode regions 35*a*, and the individual electrodes 35, whose auxiliary electrode regions 35 bare located on the base-end side of the FPC 50 in relation to the main electrode regions 35*a* are alternately disposed. Accordingly, the width of the lands 36 can be increased, whereby an inkjet head 1 of high density and high resolution can be obtained. A similar effect can be obtained with another embodiment. FIG. 9 shows another embodiment. In the embodiment, two pressure chamber groups 101*a*, 101*b* are formed in a trapezoid shape, and are disposed so as to overlap each other in the width direction of a flow passage unit 105. Actuator units 102*a*, 102*b*, having the same shape as that of the pressure chamber groups are disposed at positions opposing the pressure chamber groups 101*a*, 101*b*, thereby constituting a head main body 100. Two FPCs 103*a*, 103*b*, which are respectively connected to the two actuator units 102*a*, 102*b*, extend in opposite directions from the short sides of the respective actuator units 102*a*, 102*b* toward the long sides thereof. When individual electrodes are disposed alternately along the longitudinal direction of the flow passage unit 105 such that all the auxiliary electrode regions of individual electrodes located at positions overlapping in the width direction of the flow passage unit 105 face a one direction, and such that auxiliary electrode regions of individual electrodes located on positions not overlapping in the width direction of the flow passage unit 105 face either the tip-end side or the base-end side of the FPCs 103*a*, 103*b*, pitches between the auxiliary electrode regions are increased, and pitches between the terminals of the FPCs 103*a*, 103*b* are also increased. More specifically, in at least the individual electrode row closest to the base-end sides of the respective FPCs 103*a*, 103*b* of the plurality of individual electrode rows formed in the actuator units 102*a*, 102*b*, the above-mentioned effect can be obtained so long that individual electrodes 35, whose auxiliary electrode regions are on the tip-end sides of the FPCs 103*a*, 103*b*, and individual electrodes 3, whose auxiliary electrode regions are on the base-end sides of the same, are present in a mixed manner; although a restriction is imposed on a plane shape of the respective pressure chamber groups 101*a*, 101*b* (i.e., the plane shape is restricted such that the pressure chamber groups 101*a*, 101*b* overlap each other in the width direction of the flow passage unit 105). In addition, when, in every individual electrode row, individual electrodes, whose auxiliary electrode regions are located on the tip-end sides of the FPCs 103*a*, 103*b*, and individual electrodes, whose auxiliary electrode regions are located on the base-end sides of the same, are present in a mixed manner, widths and pitches of the wires which are connected to the respective terminals and which are formed to correspond with the every individual electrode row can be equally increased in the entire region as described above. Accordingly, fabrication of the FPCs 103*a*, 103*b* is further facilitated. Furthermore, demand for higher resolution of images or for increasing the density of the pressure chambers can be easily satisfied, and elongation of the inkjet head can also be achieved while providing a similar effect.

There will now be described an array pattern of the plurality of individual electrodes rows 37 according to the first embodiment in more detail by referring FIG. 10.

Figure 10:
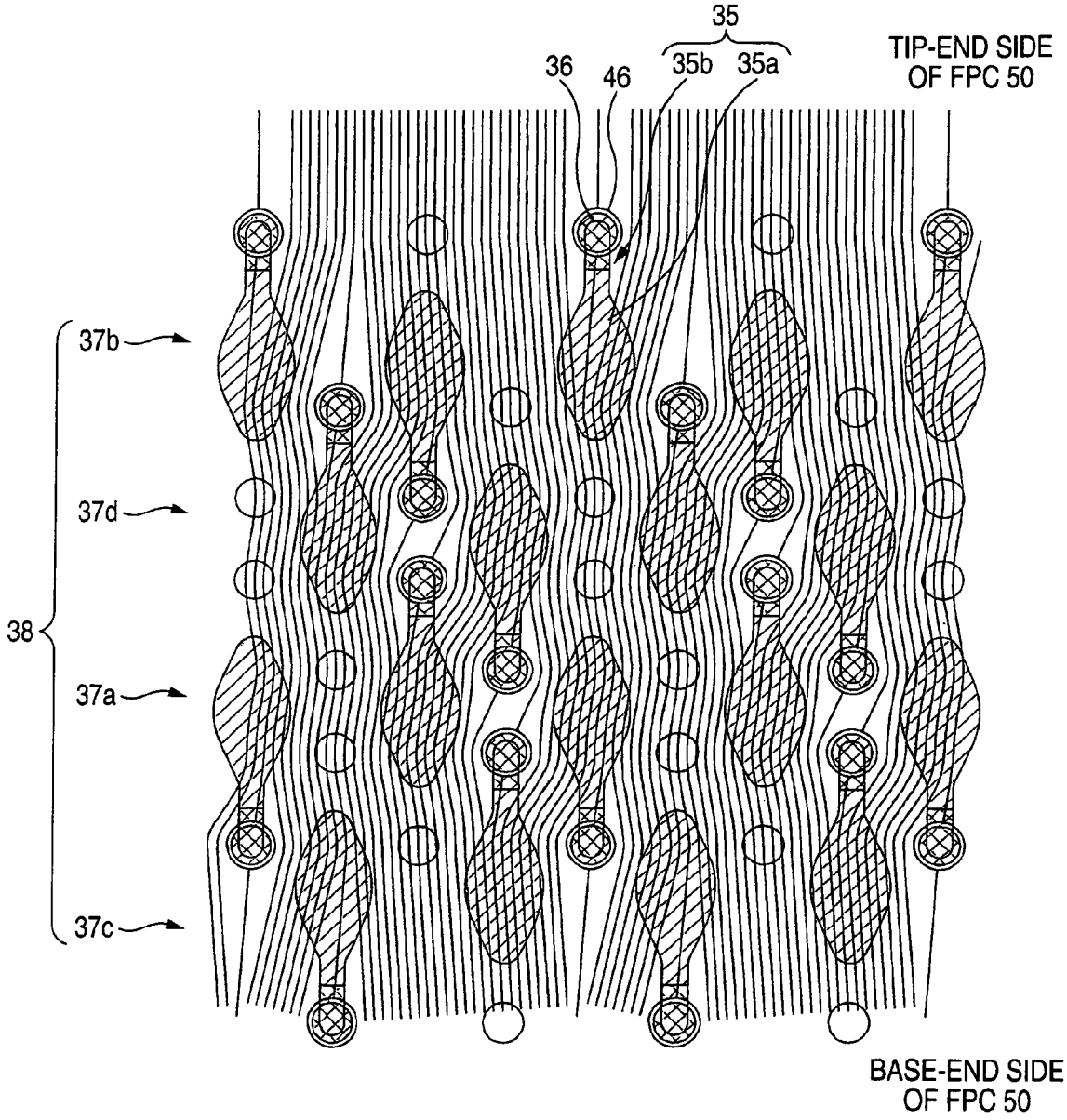
FIG. 10 is an enlarged view of the region enclosed by an alternate long and short dashed line shown in FIG. 4, wherein an array pattern of the plurality of individual electrode rows formed by individual electrodes 35 according to first embodiment of the invention is shown.

FIG. 10 is an enlarged view of the region enclosed by an alternate long and short dashed line shown in FIG. 4, wherein an array pattern of the plurality of individual electrode rows formed by individual electrodes 35 according to first embodiment of the invention.

As shown in FIG. 10, the plurality of individual electrodes 35 form a plurality of individual electrode rows 37 which are arranged in parallel to each other along the array direction A in a similar manner as the pressure chamber rows 11. The plurality of individual electrode rows 37 are grouped into individual electrode rows 37*a* to 37*d* corresponding to the pressure chamber rows 11*a* to 11*d*. The individual electrode rows 37*a* to 37*d* form a group, whereby four individual electrode groups 38 corresponding to the four pressure chamber groups 12 are formed. Each of the individual electrode rows 37 includes individual electrodes 35 in which the auxiliary electrode regions 35*b* are formed on the base-end side (the bottom side in FIG. 8 where the driver IC 75 is formed on FPC 50) of the FPC 50 in relation to the main electrode regions 35*a*, and individual electrodes 35 in which the auxiliary electrode regions 35*b* are formed on the tip-end side (the top side in FIG. 8) of the FPC 50 in relation to the main electrode region 35*a*.

Pairs of two individual electrodes 35 in the individual electrode rows 37*a*, 37*b* arranged in the main scanning direction with respect to each manifold flow passage have two array patterns which is alternately formed in the sub scanning direction.

In the first array pattern, the auxiliary electrode regions of two individual electrodes 35 constituting each pair are arranged to direct outside of the FPC 50 with each other in the main scanning direction. In other words, the auxiliary electrode region of the one individual electrode 35 (one companion to the pair) in the individual electrode rows 37*b* is directed to the tip-end side of FPC 50. The auxiliary electrode region of the other individual electrode 35 (the other companion to the pair) in the individual electrode rows 37*a* is directed to the base-end side of FPC 50.

In the second array pattern, the auxiliary electrode regions of two individual electrodes 35 constituting each pair are arranged to direct inside of the FPC 50 with each other in the main scanning direction. In other words, the auxiliary electrode region of the one individual electrode 35 (one companion to the pair) in the individual electrode rows 37*b* is directed to the base-end side of FPC 50. The auxiliary electrode region of the other individual electrode 35 (the other companion to the pair) in the individual electrode rows 37*a* is directed to the tip-end side of FPC 50.

Pairs of two individual electrodes 35 in the individual electrode rows 37*c*, 37*d* arranged in the main scanning direction with respect to each manifold flow passage have the same two array patterns as two individual electrodes 35 in the individual electrode rows 37*a* and 37*b*.

Second Embodiment

There will now be described an array pattern of the plurality of individual electrodes rows 37 according to a second embodiment of the present invention by referring FIG. 11. The second embodiment is different from the first embodiment in view of the array pattern of the plurality of individual electrodes rows 37. In other respects, the third embodiment is the same as the first embodiment.

In the following descriptions, the same reference numerals are assigned to elements having the same configurations as those described in connection with the first embodiment.

Figure 11:
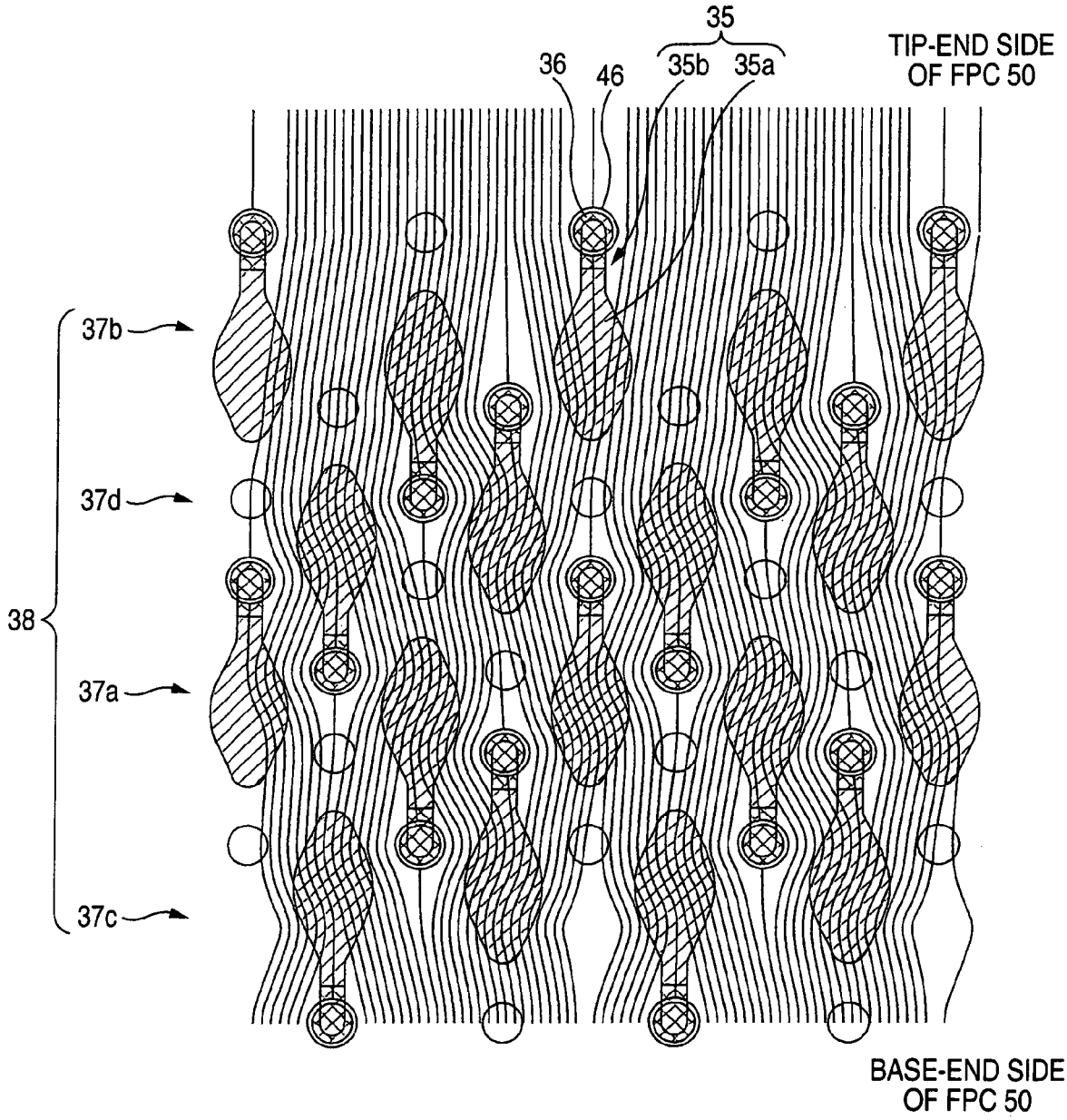
FIG. 11 is an enlarged view of the region enclosed by an alternate long and short dashed line shown in FIG. 5, wherein an array pattern of the plurality of individual electrode rows formed by individual electrodes 35 according to second embodiment of the invention is shown.

FIG. 11 is an enlarged view of the region enclosed by an alternate long and short dashed line shown in FIG. 4, wherein an array pattern of the plurality of individual electrode rows formed by individual electrodes 35 according to second embodiment of the invention is shown.

As shown in FIG. 11, the plurality of individual electrodes 35 form a plurality of individual electrode rows 37 which are arranged in parallel to each other along the array direction A in a similar manner as the pressure chamber rows 11. The plurality of individual electrode rows 37 are grouped into individual electrode rows 37*a* to 37*d* corresponding to the pressure chamber rows 11*a* to 11*d*. The individual electrode rows 37*a* to 37*d* form a group, whereby four individual electrode groups 38 corresponding to the four pressure chamber groups 12 are formed. Each of the individual electrode rows 37 includes individual electrodes 35 in which the auxiliary electrode regions 35*b* are formed on the base-end side (the bottom side in FIG. 8 where the driver IC 75 is formed on FPC 50) of the FPC 50 in relation to the main electrode regions 35*a*, and individual electrodes 35 in which the auxiliary electrode regions 35*b* are formed on the tip-end side (the top side in FIG. 8) of the FPC 50 in relation to the main electrode region 35*a*.

Pairs of two individual electrodes 35 in the individual electrode rows 37*a*, 37*b* arranged in the main scanning direction with respect to each manifold flow passage has two array patterns which is alternately formed in the sub scanning direction.

In the first array pattern, the auxiliary electrode regions of two individual electrodes 35 constituting each pair are arranged to direct in the same direction. In other words, the auxiliary electrode region of one individual electrode 35 (one companion to the pair) in the individual electrode rows 37*a* is directed to a same direction as the auxiliary electrode region of one individual electrode 35 (the other companion to the pair) in the individual electrode rows 37*b*. In the third embodiment of the invention, the same direction may be directed to the tip-end side of FPC 50 in the main scanning direction or the base-end side of FPC 50 in the main scanning direction.

In the second array pattern, the auxiliary electrode regions of two individual electrode 35 constituting each pair are arranged to direct in the same direction, but opposite to the direction that the auxiliary electrode regions of two individual electrode 35 constituting each pair are arranged to direct in the first array pattern.

Pairs of two individual electrodes 35 in the individual electrode rows 37*c*, 37*d* arranged in the main scanning direction with respect to each manifold flow passage have the same two array patterns as two individual electrodes 35 in the individual electrode rows 37*a* and 37*b*.

According to the embodiments, in at least the individual electrode row which is the most distant from the tip end of the flat flexible cable in the direction in which the wires extend, the individual electrodes whose auxiliary electrode regions are located closer to the tip-end side of the flat flexible cable than are the main electrode regions and the individual electrodes whose auxiliary electrode regions are located closer to the base-end side of the flat flexible cable than are the main electrode regions are preferably disposed alternately. By virtue of the above configuration, pitches of the terminals formed corresponding to the individual electrode closest to the base end of the flat flexible cable can be equally increased in the entire region. Accordingly, fabrication of the flat flexible cable is further facilitated. Furthermore, meeting demand for higher density of images or for increasing the density of the pressure chambers is facilitated.

In addition, according to the embodiments, in all the individual electrode rows, the individual electrodes whose auxiliary electrode regions are located closer to the tip-end side of the flat flexible cable than are the main electrode regions and the individual electrodes whose auxiliary electrode regions are located closer to the base-end side of the flat flexible cable than are the main electrode regions are preferably present in a mixed manner. By virtue of the above configuration, widths and pitches of the wires connected to the respective terminals formed in correspondence to each of the individual electrode rows can be increased. Accordingly, fabrication of the flat flexible cable is further facilitated. Furthermore, meeting demand for higher density of images or for increasing the density of the pressure chambers is further facilitated.

According to the embodiments, in all the individual electrode rows, the individual electrodes whose auxiliary electrode regions are located closer to the tip-end side of the flat flexible cable than are the main electrode regions and the individual electrodes whose auxiliary electrode regions are located closer to the base-end side of the flat flexible cable than are the main electrode regions are preferably disposed alternately. By virtue of the above configuration, pitches of the terminals formed in correspondence to every individual electrode row can be equally increased in the entire region. Accordingly, fabrication of the flat flexible cable is further facilitated. Furthermore, meeting demand for higher density of images or for increasing the density of the pressure chambers is further facilitated.

According to the embodiments, the main electrode regions are disposed at positions opposing the pressure chambers, a shape of each of the pressure chambers in plan view is a substantial parallelogram having two acute angle portions, and the direction crossing the one direction is parallel to a shorter diagonal line of the pressure chambers. When configured as above, the inkjet head is configured such that the pressure chambers are arrayed at a high density therein.

Furthermore, the plurality of pressure chambers and the plurality of individual electrodes may be arranged in a staggered pattern. When such an arrangement is employed, the individual electrodes are in a regular array, thereby facilitating design.

Heretofore, preferred embodiments of the invention have been described; however, the embodiments of the invention are not limited thereto, and can be modified in various ways within the scope of the invention as set forth in the appended claims. For instance, the inkjet head 1 of the above-mentioned embodiment is applied to a serial-type inkjet printer; however, it can also be applied to an inkjet head employed in a line-type inkjet head printer. In addition, the inkjet head 1 is driven by a piezoelectric actuator unit, whereby ink is ejected from a nozzle. However, the present invention is applicable to an inkjet head of a method wherein inks in the respective pressure chambers are heated upon signals from the FPC 50, and ejection energy is imparted to the ink in the pressure chambers. More specifically, when the same configuration as that of the aforementioned embodiment is applied to the land 36 of the individual electrode 35 connected to the terminal 46 of the FPC 50; and heating members are disposed in the respective pressure chambers, and the individual electrodes corresponding to the respective pressure chambers are connected to the heating members, the heating members can be heated upon signals from the FPC. The invention is also applicable to such an inkjet head.

What is claimed is:

1. An inkjet head comprising:

a flow passage unit in which a plurality of pressure chambers which respectively communicate with nozzles are arranged on a plane, the flow passage unit including ink flow passages that connect ink supply ports with the nozzles by way of the pressure chambers respectively, a shape of the pressure chambers in plan view being a substantial parallelogram having two acute angle portions;

an actuator unit that includes a plurality of individual electrodes each having:

a main electrode region corresponding to the respective pressure chamber, the main electrode regions being disposed at positions opposing the pressure chambers, an auxiliary electrode region connected to the main electrode region, the actuator unit being fixed onto the plane of the flow passage unit, and imparting ejection energy to ink in the pressure chambers; and a flat flexible cable that includes a plurality of terminals which are electrically connected with the respective auxiliary electrode regions, and a plurality of wires connected to the respective terminals and extending in one direction from the terminals;

wherein:

a plurality of individual electrode rows, in each of which the plurality of individual electrodes are arranged along a direction crossing the one direction, the direction crossing the one direction being parallel to shorter diagonal lines of the pressure chambers, the individual electrode rows being arranged in the actuator unit in such a manner that the individual electrode rows are parallel to each other;

in at least one individual electrode row which is the most distant from a tip end of the flat flexible cable in a direction where the wires extend, individual electrodes whose auxiliary electrode regions are located closer to a tip-end side of the flat flexible cable than the main electrode regions and individual electrodes whose auxiliary electrode regions are located closer to a base-end side of the flat flexible cable than the main electrode regions are mixed.

2. The inkjet head according to claim 1, wherein:

in the at least one individual electrode row most distant from the tip end of the flat flexible cable in a direction in which the wires extend, the individual electrodes whose auxiliary electrode regions are located closer to the tip-end side of the flat flexible cable than the main electrode regions and the individual electrodes whose auxiliary electrode regions are located closer to the base-end side of the flat flexible cable than the main electrode regions are disposed alternately.

3. The inkjet head according to claim 1, wherein:

in each of the individual electrode rows, the individual electrodes whose auxiliary electrode regions are located closer to the tip-end side of the flat flexible cable than the main electrode regions and the individual electrodes whose auxiliary electrode regions are located closer to the base-end side of the flat flexible cable than the main electrode regions are mixed.

4. The inkjet head according to claim 1, wherein:

in each of the individual electrode rows, the individual electrodes whose auxiliary electrode regions are located closer to the tip-end side of the flat flexible cable than the main electrode regions and the individual electrodes whose auxiliary electrode regions are located closer to the base-end side of the flat flexible cable than the main electrode regions are alternately disposed.

5. The inkjet head according to claim 1, wherein:

the plurality of pressure chambers and the plurality of individual electrodes are disposed in a staggered pattern.

6. The inkjet head according to claim 1, wherein:

the actuator unit is configured by laminating a plurality of piezoelectric sheets;

the plurality of piezoelectric sheets includes at least one active piezoelectric sheet and at least one inactive piezoelectric sheet, the at least one active piezoelectric sheet having active portions, each of the active portions sandwiched by one of the individual electrodes and a common electrode extending over the pressure chambers, the at least one inactive piezoelectric sheet not having active portions; and one of the plurality of piezoelectric sheets which is the most distant from the flow passage unit is the active piezoelectric sheet and another one of the plurality of piezoelectric sheets which is proximal to the flow passage unit is the inactive piezoelectric sheet.

7. The inkjet head according to claim 1, wherein:

at least one pair of the two individual electrode rows has first pairs of two individual electrodes and second pairs of two electrodes;

the first pairs of two individual electrodes and the second pairs of two individual electrodes are arranged in the direction crossing the one direction;

auxiliary electrode regions of each of the first pairs of two individual electrodes are directed outside of the flat flexible cable with each other; and auxiliary electrode regions of each of the second pairs of two individual electrodes are directed inside of the flat flexible cable with each other.

8. The inkjet head according to claim 7, wherein:

the first pairs of two individual electrodes and the second pairs of two individual electrodes are alternately arranged in the direction crossing to the one direction with respect to each manifold flow passage.

9. The inkjet head according to claim 1, wherein:

at least one pair of the individual electrode rows has pairs of two individual electrodes which are arranged in the direction crossing the one direction;

an auxiliary electrode region of the one individual electrode of each of the pairs is arranged to direct in a same direction as an auxiliary electrode region of the other individual electrode of the each of the pairs.

10. The inkjet head according to claim 9, wherein:

the pairs includes first pairs and second pairs;

auxiliary electrode regions of each of the first pairs are directed to the tip-end side of the flat flexible cable; and auxiliary electrode regions of each of the second pairs are directed to the base-end side of the flat flexible cable.

11. The inkjet head according to claim 9, wherein:

the first pairs and the second pairs are alternately arranged in the direction crossing the one direction.

12. The inkjet head according to claim 1, wherein:

the actuator unit includes a plurality of actuator units arranged along a longitudinal direction of the flow passage unit;

a shape of each of the actuator units in plan view is a substantial trapezoid having a short side, a long side parallel to the short side and oblique sides;

the short side and the long side of each of the actuator units are substantially parallel to the longitudinal direction of the flow passage unit;

the oblique sides of neighboring actuator units are partially overlap each other in a lateral direction of the flow passage unit;

the flat flexible cable includes a plurality of flat flexible cables respectively connected to the plurality of actuator units; and the flexible cables connected to neighboring actuator units extend in opposite directions from the short sides of the respective actuator units toward the long sides of the respective actuator units.

13. The inkjet head according to claim 1, wherein the individual electrodes are arranged in three directions.

14. The inkjet head according to claim 13, wherein the three directions are a first direction, a direction perpendicular to the first direction, and a direction at an obtuse angle to the first direction.

15. The inkjet head according to claim 1, wherein the main electrode regions of the individual electrodes in the at least one individual electrode row are arranged substantially along the direction crossing the one direction.

16. An inkjet head comprising:

a flow passage unit that, in which a plurality of pressure chambers which respectively communicate with nozzles are arranged on a plane, the flow passage unit including ink flow passages that connect ink supply ports with the nozzles by way of the pressure chambers respectively;

an actuator unit that includes a plurality of individual electrodes, each of which having a main electrode region and an auxiliary electrode region connected to the main electrode region, the actuator unit being fixed onto the plane of the flow passage unit, and changing volumes of the pressure chambers; and a flat flexible cable which includes a plurality of terminals connected with the respective auxiliary electrode regions, and a plurality of wires connected to the respective terminals extending in one direction;

wherein:

a plurality of the pressure chamber rows, in each of which the pressure chambers of a substantial parallelogram shape in plan view having two acute angle portions are arranged along a direction crossing the one direction, are arranged in the flow passage unit being parallel to each other;

in the actuator unit, the individual electrodes arranged opposing the pressure chambers form a plurality of individual electrode rows which are parallel to each other; and in all the individual electrode rows, individual electrodes whose auxiliary electrode regions are located closer to the tip-end side of the flat flexible cable than the main electrode regions and individual electrodes whose auxiliary electrode regions are located closer to the base-end side of the flat flexible cable than the main electrode regions are alternately disposed.

17. The inkjet head according to claim 16, wherein:

the actuator unit is configured by laminating a plurality of piezoelectric sheets;

the plurality of piezoelectric sheets includes at least one active piezoelectric sheet and at least one inactive piezoelectric sheet, the at least one active piezoelectric sheet having active portions, each of the active portions being sandwiched by one of the individual electrodes and a common electrode extending over the pressure chambers, the at least one inactive piezoelectric sheet not having active portions; and one of the plurality of piezoelectric sheets which is the most distant from the flow passage unit is the active piezoelectric sheet and another one of the plurality of piezoelectric sheets which is proximal to the flow passage unit is the inactive piezoelectric sheet.

* * * * *